US008015003B2

(12) United States Patent
Wilson et al.

(10) Patent No.: US 8,015,003 B2
(45) Date of Patent: Sep. 6, 2011

(54) DENOISING ACOUSTIC SIGNALS USING CONSTRAINED NON-NEGATIVE MATRIX FACTORIZATION

(75) Inventors: Kevin W. Wilson, Cambridge, MA (US); Ajay Divakaran, Woburn, MA (US); Bhiksha Ramakrishnan, Watertown, MA (US); Paris Smaragdis, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 960 days.

(21) Appl. No.: 11/942,015

(22) Filed: Nov. 19, 2007

(65) Prior Publication Data

US 2009/0132245 A1 May 21, 2009

(51) Int. Cl.
*G10L 21/06* (2006.01)

(52) U.S. Cl. ..... 704/226

(58) Field of Classification Search ..... 704/226
See application file for complete search history.

(56) References Cited

U.S. PATENT DOCUMENTS

| | | | | |
|---|---|---|---|---|
| 7,415,392 | B2 * | 8/2008 | Smaragdis | 702/190 |
| 7,424,150 | B2 * | 9/2008 | Cooper et al. | 382/173 |
| 7,672,834 | B2 * | 3/2010 | Smaragdis | 704/204 |
| 7,698,143 | B2 * | 4/2010 | Ramakrishnan et al. | 704/500 |
| 2005/0222840 | A1 | 10/2005 | Smaragdis | |

OTHER PUBLICATIONS

Cichocki et al.: "new algorithms for non-negative matrix factorization in applications to blind source separation", May 14, 2006.

* cited by examiner

*Primary Examiner* — Susan McFadden
(74) *Attorney, Agent, or Firm* — Dirk Brinkman; Gene Vinokur

(57) ABSTRACT

A method and system denoises a mixed signal. A constrained non-negative matrix factorization (NMF) is applied to the mixed signal. The NMF is constrained by a denoising model, in which the denoising model includes training basis matrices of a training acoustic signal and a training noise signal, and statistics of weights of the training basis matrices. The applying produces weight of a basis matrix of the acoustic signal of the mixed signal. A product of the weights of the basis matrix of the acoustic signal and the training basis matrices of the training acoustic signal and the training noise signal is taken to reconstruct the acoustic signal. The mixed signal can be speech and noise.

9 Claims, 3 Drawing Sheets

100

200

300

DENOISING ACOUSTIC SIGNALS USING CONSTRAINED NON-NEGATIVE MATRIX FACTORIZATION

FIELD OF THE INVENTION

This invention relates generally to processing acoustic signals, and more particularly to removing additive noise from acoustic signals such as speech.

BACKGROUND OF THE INVENTION

Noise

Removing additive noise from acoustic signals, such as speech has a number of applications in telephony, audio voice recording, and electronic voice communication. Noise is pervasive in urban environments, factories, airplanes, vehicles, and the like.

It is particularly difficult to denoise time-varying noise, which more accurately reflects real noise in the environment. Typically, non-stationary noise cancellation cannot be achieved by suppression techniques that use a static noise model. Conventional approaches such as spectral subtraction and Wiener filtering have traditionally used static or slowly-varying noise estimates, and therefore have been restricted to stationary or quasi-stationary noise.

Non-Negative Matrix Factorization

Non-negative matrix factorization (NMF) optimally solves an equation $$V \approx WH.$$

The conventional formulation of the NMF is defined as follows. Starting with a non-negative M×N matrix V, the goal is to approximate the matrix V as a product of two non-negative matrices W and H. An error is minimized when the matrix V is reconstructed approximately by the product WH. This provides a way of decomposing a signal V into a convex combination of non-negative matrices.

When the signal V is a spectrogram and the matrix is a set of spectral shapes, the NMF can separate single-channel mixtures of sounds by associating different columns of the matrix with different sound sources, see U.S. Patent Application 20050222840 "Method and system for separating multiple sound sources from monophonic input with non-negative matrix factor deconvolution," by Smaragdis et al. on Oct. 6, 2005, incorporated herein by reference.

NMF works well for separating sounds when the spectrograms for different acoustic signals are sufficiently distinct. For example, if one source, such as a flute, generates only harmonic sounds and another source, such as a snare drum, generates only non-harmonic sounds, the spectrogram for one source is distinct from the spectrogram of other source.

Speech

Speech includes harmonic and non-harmonic sounds. The harmonic sounds can have different fundamental frequencies at different times. Speech can have energy across a wide range of frequencies. The spectra of non-stationary noise can be similar to speech. Therefore, in a speech denoising application, where one "source" is speech and the other "source" is additive noise, the overlap between speech and noise models degrades the performance of the denoising.

Therefore, it is desired to adapt non-negative matrix, factorization to the problem of denoising speech with additive non-stationary noise.

SUMMARY OF THE INVENTION

The embodiments of the invention provide a method and system for denoising mixed acoustic signals. More particularly, the method denoises speech signals. The denoising uses a constrained non-negative matrix factorization (NMF) in combination with statistical speech and noise models.

DETAILED DESCRIPTION OF THE PREFERRED EMBODIMENT

Figure 1:
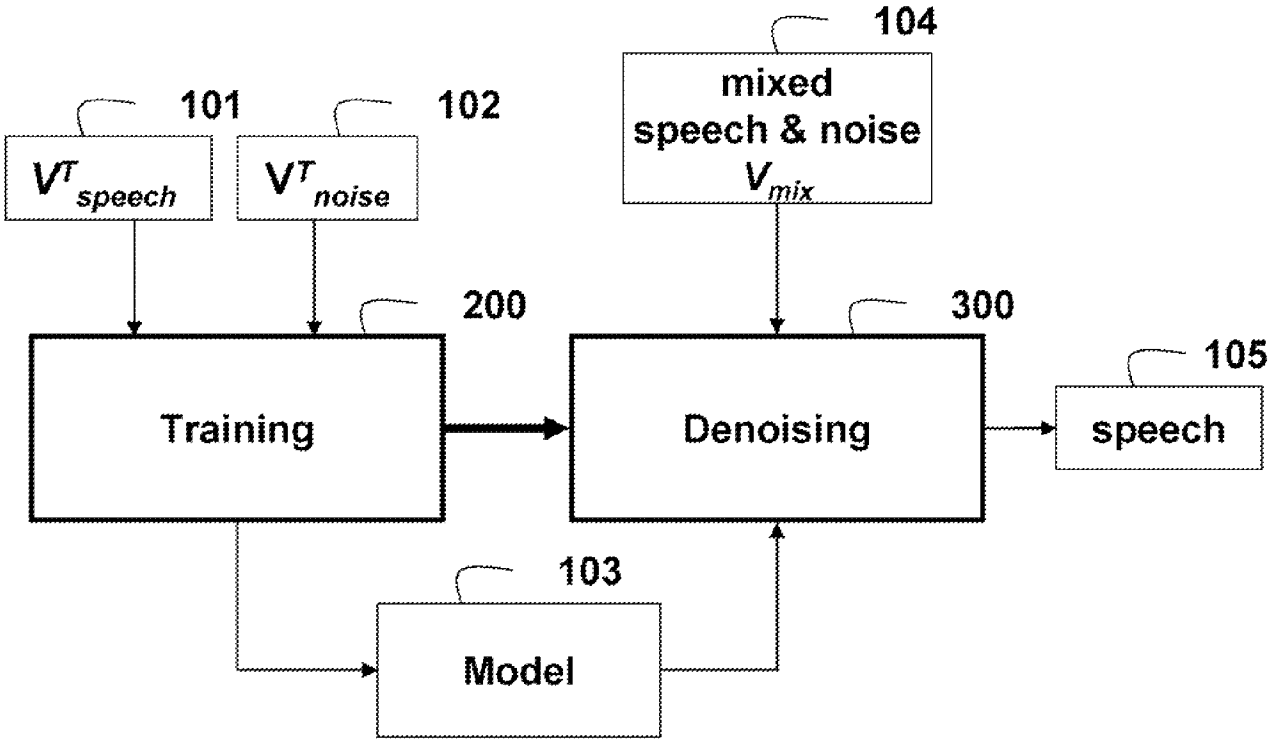
FIG. 1 is a flow diagram of a method for denoising acoustic signals according to embodiments of the invention.

FIG. 1 shows a method 100 for denoising a mixture of acoustic and noise signals according to embodiments of our invention. The method includes one-time training 200 and a real-time denoising 300.

Input, to the one-time training 200 comprises a training acoustic signal ($V^T_{speech}$) 101 and a training noise signal, ($V^T_{noise}$) 102. The training signals are representative of the type of signals to be denoised, e.g., speech with non-stationary noise. It should be understood, that the method can be adapted to denoise other types of acoustic signals, e.g., music, by changing the training signals accordingly. Output of the training is a denoising model 103. The model can be stored in a memory for later use.

Input to the real-time denoising comprises the model 103 and a mixed signal ($V_{mix}$) 104, e.g., speech and non-stationary noise. The output of the denoising is an estimate of the acoustic (speech) portion 105 of the mixed signal.

During the one-time training, non-negative matrix factorization (NMF) 210 is applied independently to the acoustic signal 101 and the noise signal 102 to produce the model 103.

The NMFs 210 independently produces training basis matrices ($W^T$) 211-212 and ($H^T$) weights 213-214 of the training basis matrices for the acoustic and speech signals, respectively. Statistics 221-222, i.e., the mean and covariance are determined for the weights 213-214. The training basis matrices 211-212, means and covariances 221-222 of the training speech and noise signals form the denoising model 103.

During real-time denoising, constrained non-negative matrix factorization (CNMF) according to embodiments of the invention is applied to the mixed signal ($V_{mix}$) 104. The CNMF is constrained by the model 103. Specifically, the CNMF assumes that the prior training matrix 211 obtained during training accurately represent a distribution of the acoustic portion of the mixed signal 104. Therefore, during the CNMF, the basis matrix is fixed to be the training basis matrix 211, and weights ($H_{all}$) 302 for the fixed training basis matrix 211 are determined optimally according the prior statistics (mean and covariance) 221-222 of the model during the CNMF 310. Then, the output speech signal 105 can be reconstructed by taking the product of the optimal weights 302 and the prior basis matrices 211.

Training

Figure 2:
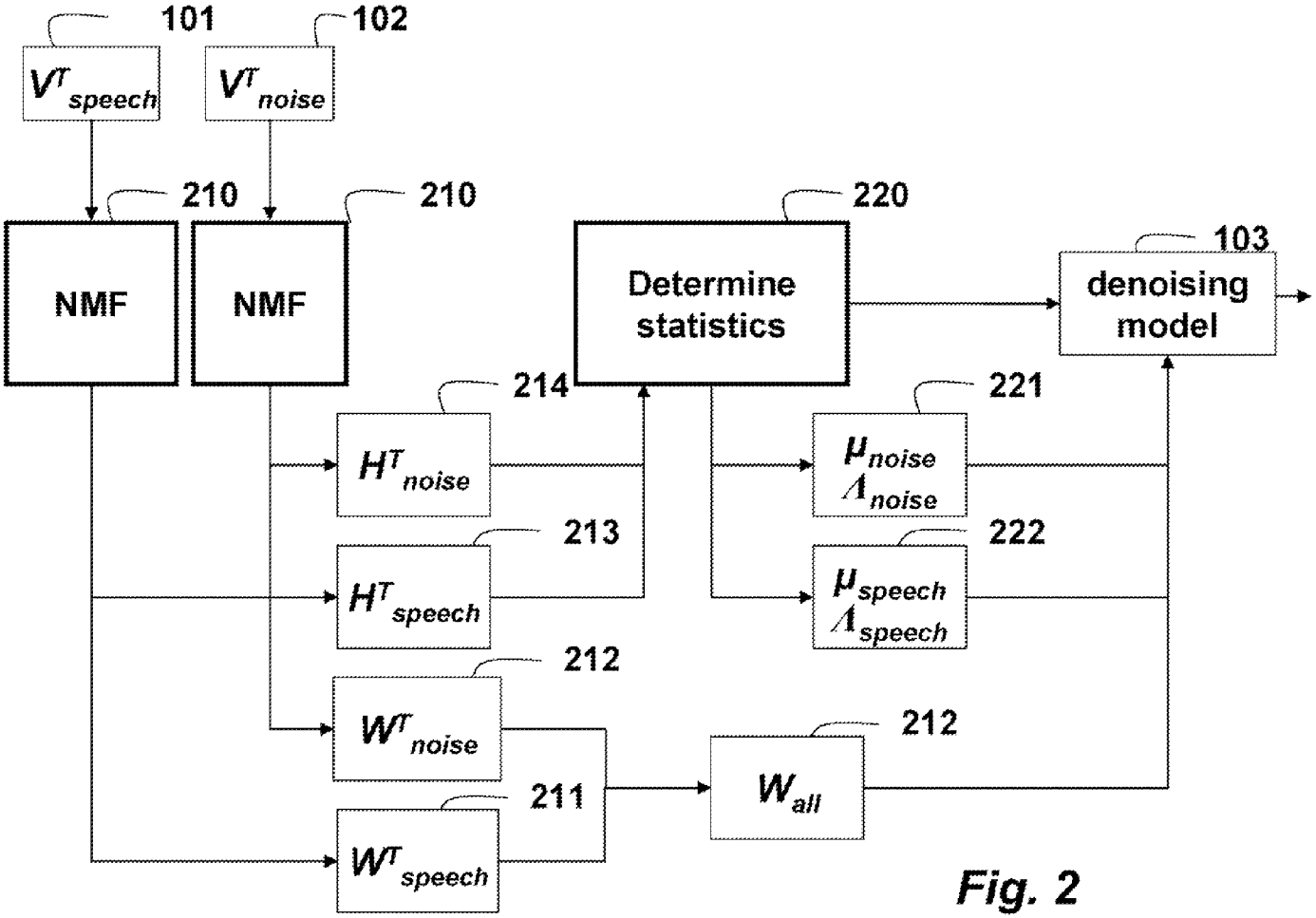
FIG. 2 is a flow diagram of a training stage of the method of FIG. 1.

During training 200 as shown in FIG. 2, we have a speech spectrogram $V_{speech}$ 101 of size $n_f \times n_{st}$, and a noise spectrogram $V_{noise}$ 102 of size $n_f \times n_{nt}$, where $n_f$ is a number of frequency bins, $n_{st}$ is a number of speech frames, and $n_{nt}$ is a number of noise frames.

All the signals, in the form of spectrograms, as described herein are digitized and sampled into frames as known in the art. When we refer to an acoustic signal, we specifically mean a known or identifiable audio signal, e.g., speech or music. Random noise is not considered an identifiable acoustic signal for the purpose of this invention. The mixed signal 104 combines the acoustic signal with noise. The object of the invention is to remove the noise so that just the identifiable acoustic portion 105 remains.

Different objective functions lead to different variants of the NMF. For example, a Kullback-Leibler (KL) divergence between the matrices V and WH, denoted D(V||WH), works well for acoustic source separation, see Smaragdis et all. Therefore, we prefer to use the KL divergence in the embodiments of our denoising invention. Generalization to other objective functions using the techniques is straight forward, see A. Cichocki, R. Zdunek, and S. Amari, "New algorithms for non-negative matrix factorization in applications to blind source separation," in IEEE International Conference on Acoustics, Speech, and Signal Processing, 2006, vol. 5, pp. 621-625, incorporated herein by reference.

During training, we apply the NMF 210 separately on the speech spectrogram 101 and the noise spectrogram 102 to produce the respective basis matrices $W^T_{speech}$ 211 and $W^T_{noise}$ 212, and the respective weights $H^T_{speech}$ 213 and $H^T_{noise}$ 214.

We minimize $D(V^T_{speech}\|W^T_{speech}\ H^T_{speech})$ and $D(V^T_{speech}\|W^T_{speech}H^T_{speech})$, respectively. The matrices $W_{speech}$ and $W_{noise}$ are each of size $n_f \times n_b$, where $n_b$ is the number of basis functions representing each source. The weight matrices $H_{speech}$ and $H_{noise}$ are of size $n_b \times n_{st}$ and $n_b \times n_{nt}$, respectively, and represent the time-varying activation levels of the training basis matrices.

We determine 220 empirically the mean and covariance statistics of the logarithmic values the weight matrices $H^T_{speech}$ and $H^t_{noise}$. Specifically, we determine the mean $\mu_{speech}$ and covariance $\Lambda_{speech}$ 221 of the speech weights, and the mean $\mu_{noise}$ and covariance $\Lambda_{noise}$ w222 of the noise weights. Each mean $\mu$ is a length $n_b$ vector, and each covariance $\Lambda$ is a $n_b \times n_b$ matrix.

We select this implicitly Gaussian representation for computational convenience. The logarithmic domain yields better results than the linear domain. This is consistent with the fact that a Gaussian representation in the linear domain would allow both positive and negative values which is inconsistent with the non-negative constraint on the matrix H.

We concatenate the two sets of basis matrices 211 and 213 to form a matrix $W_{all}$ 215 of size $nf \times 2n_b$. This concatenated set of basis matrices is used to represent a signal containing a mixture of speech and independent noise. We also concatenate the statistics $\mu_{all}=[\mu_{speech}; \mu_{noise}]$ and $\Lambda_{all}=[\Lambda_{speech}\ 0; 0\ \Lambda_{noise}]$. The concatenated basis matrices 211 and 213 and the concatenated statistics 221-222 form our denoising model 103.

Denoising

Figure 3:
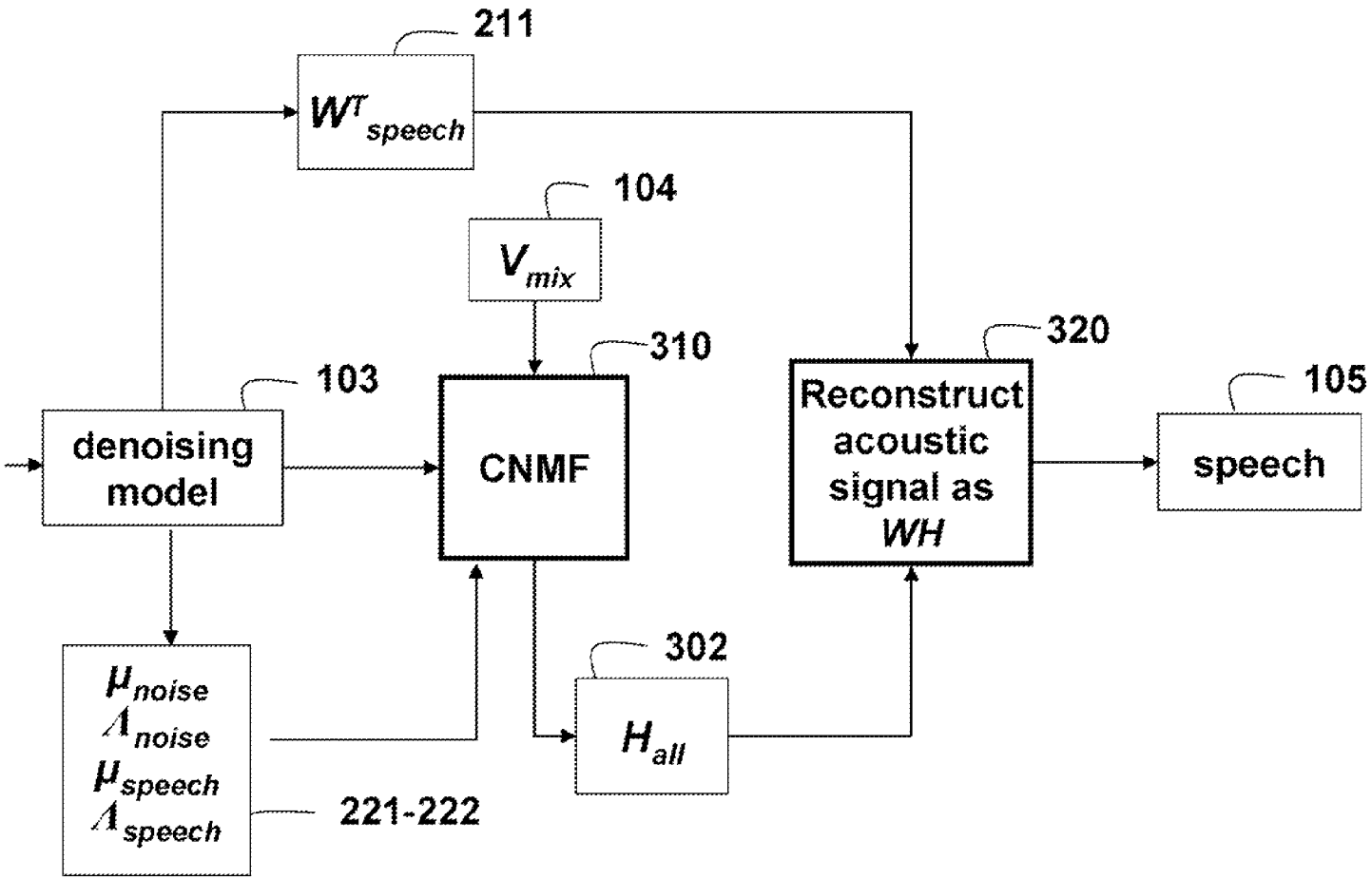
FIG. 3 is a flow diagram, of a denoising stage of the method of FIG. 1.

During real-time denoising as shown in FIG. 3 we hold the concatenated matrix $W_{all}$ 215 of the model 103 fixed on the assumption that the matrix accurately represents the type of speech and noise we want to process.

Objective Function

It is our objective to determine the optimal weights $H_{all}$ 302 which minimizes $$D_{reg}(V \parallel WH) = \sum_{ik}\left(V_{ik}\log\frac{V_{ik}}{(WH)_{ik}} + V_{ik} - (WH)_{ik}\right) - \alpha L(H) \tag{1}$$

-continued $$L(H_{all}) = -\frac{1}{2}\sum_k \{(\log H_{all_{ik}} - \mu_{all})^T \Lambda_{all}^{-1}(\log H_{all_{ik}} - \mu_{all}) - \log[(2\pi)^{2n_b}|\Lambda|]\}, \tag{2}$$

where $D_{reg}$ is the regularized KL divergence objective function, i is an index over frequency, k is an index over time, and $\alpha$ is an adjustable parameter that controls the influence of the likelihood function, L(H), on the overall objective function, $D_{reg}$. When $\alpha$ is zero, this Equation 1 equals the KL divergence objective function. For a non-zero $\alpha$, there is an added penalty proportional to the negative log likelihood under our joint Gaussian model for log H. This term encourages the resulting matrix $H_{all}$ to be consistent with the statistics 221-223 of the matrices $H_{speech}$ and $H_{noise}$ as empirically determined during training. Varying $\alpha$ enables us to control the trade-off between fitting the whole (observed mixed speech) versus matching the expected statistics of the "parts" (speech and noise statistics), and achieves a high likelihood under our model.

Following Cichocki et al., the multiplicative update rule for the weight matrix $H_{all}$ is $$H_{all_{\alpha\mu}} \leftarrow H_{all_{\alpha\mu}} \frac{\sum_i W_{all_{i\alpha}} V_{mix_{i\mu}} / (W_{all} H_{all})_{i\mu}}{\left[\sum_k W_{all_{k\alpha}} + \alpha\varphi(H_{all})\right]_\varepsilon} \tag{30}$$

$$\varphi(H_{all_{\alpha\mu}}) = -\frac{\partial L(H_{all})}{\partial H_{all_{\alpha\mu}}} = -\frac{(A_{all}^{-1}\log H_{all})_{\alpha\mu}}{H_{all_{\alpha\mu}}}$$

where $[\ ]_\epsilon$ indicates that any values within the brackets less than the small positive constant $\epsilon$ are replaced with $\epsilon$ to prevent violations of the non-negativity constraint and to avoid divisions by zero.

We reconstruct 320 the denoised spectrogram, e.g., clean speech 105 as $$\hat{V}_{speech} = W_{speech} H_{all(1:nb)},$$

using the training basis matrix 211 and the top rows of the matrix $H_{all}$.

EFFECT OF THE INVENTION

The method according to the embodiments of the invention can denoise speech in the presence of non-stationary noise. Results indicate superior performance when compared with conventional Wiener filter denoising with static noise models on a range of noise types.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for denoising a mixed signals, in which the mixed signal includes an acoustic signal and a noise signal, comprising:

applying a constrained non-negative matrix factorization (NMF) to the mixed signal, in which the NMF is constrained by a denoising model, in which the denoising model comprises training basis matrices of a training acoustic signal and a training noise signal, and statistics of weights of the training basis matrices, and in which the applying produces weight of a basis matrix of the acoustic signal of the mixed signal; and taking a product of the weights of the basis matrix of the acoustic signal and the training basis matrices of the training acoustic signal and the training noise signal to reconstructing the acoustic signal, wherein steps of the method are performed by a processor.

2. The method of claim 1, in which the noise signal is non-stationary.

3. The method of claim 1, in which the statistics include a mean and a covariance of the weights of the training basis matrices.

4. The method of claim 1, in which the acoustic signal is speech.

5. The method of claim 1, in which the denoising is performed in real-time.

6. The method of claim 1, in which the denoising model is stored in a memory.

7. The method of claim 1, in which all signals are in the form of digitized spectrograms.

8. The method of claim 1, further comprising:

minimizing a Kullback-Leibler divergence between matrices $V_{speech}$ representing the training acoustic signal, and matrices $W_{speech}$ and $H_{speech}$ representing the training basis matrices and the weights of the training acoustic signal; and minimizing the Kullback-Leibler divergence between matrices $V_{noise}$ representing the training noise signal, and matrices $W_{noise}$ and $H_{noise}$ representing training noise matrices and weights of the training noise signal.

9. The method of claim 1, in which the statistics are determined in a logarithmic domain.

* * * * *